US011304545B2

(12) United States Patent
Currey

(10) Patent No.: US 11,304,545 B2
(45) Date of Patent: Apr. 19, 2022

(54) PERFORATED BOARD AND HANGER STORAGE SYSTEM

(71) Applicant: Larry Currey, Fort Worth, TX (US)

(72) Inventor: Larry Currey, Fort Worth, TX (US)

( * ) Notice: Subject to any disclaimer, the term of this patent is extended or adjusted under 35 U.S.C. 154(b) by 86 days.

(21) Appl. No.: 16/682,776

(22) Filed: Nov. 13, 2019

(65) Prior Publication Data

US 2021/0137286 A1 May 13, 2021

(51) Int. Cl.
*A47F 5/08* (2006.01)

(52) U.S. Cl.
CPC ..... *A47F 5/0823* (2013.01); *A47F 5/083* (2013.01)

(58) Field of Classification Search
CPC ..... A47F 5/0823; A47F 5/083; A47F 5/0815; A47F 5/0807
USPC ..... 248/220.31, 220.43, 220.42, 220.41
See application file for complete search history.

(56) References Cited

U.S. PATENT DOCUMENTS 1,416,969 A * 5/1922 O'Connor ..... A47G 25/08 248/220.42
2,312,985 A * 3/1943 Bales ..... A47F 5/0823 248/220.43
2,961,724 A * 11/1960 Alling ..... F16B 2/24 248/220.43
3,193,225 A * 7/1965 Terlinde ..... A47F 5/0823 248/220.43
3,241,799 A * 3/1966 Terlinde ..... A47F 5/0823 248/220.43
3,319,917 A * 5/1967 Bilodeau ..... A47G 25/0678 248/220.43
3,401,909 A * 9/1968 Kalahar ..... A47F 5/0823 248/220.43
3,452,959 A * 7/1969 Ishikawa ..... A47F 5/0815 248/488
5,137,239 A * 8/1992 Horton ..... A47B 81/005 248/220.43
5,165,640 A * 11/1992 Williams, 3rd ..... A47F 5/0823 248/220.43
5,749,194 A * 5/1998 Andres ..... H02G 3/10 174/480
5,881,982 A * 3/1999 Hollingsworth ..... A47F 5/0823 248/220.31
6,443,316 B1 * 9/2002 Mao ..... A47F 5/0807 211/41.3
7,481,406 B2 * 1/2009 Lang ..... A47F 5/0815 248/220.31
8,522,986 B2 * 9/2013 Kitchen ..... B25H 3/04 211/59.1

(Continued)

*Primary Examiner* — Patrick D Hawn
(74) *Attorney, Agent, or Firm* — Decker Jones, PC; Brian K. Yost

(57) ABSTRACT

A perforated board and hanger storage system is provided, the system comprising a perforated board and one or more hangers. The perforated board comprises a board portion, a perimeter rib structure, an interior rib structure, and evenly spaced board through openings. The perimeter and interior rib structures extend from a wall facing surface. Adjacent to the perimeter rib structure are a plurality of tube portions adapted to receive fasteners. The hangers comprise a vertical member, an extension member, an upper peg and a lower peg. The upper peg extends rearward from an upper portion of the vertical member. The lower peg extends frontward and downward from a lower portion of the vertical member.

7 Claims, 4 Drawing Sheets

(56) References Cited

U.S. PATENT DOCUMENTS

| | | | | |
|---|---|---|---|---|
| 8,827,089 | B2 * | 9/2014 | Stukenberg | A47F 5/0815 211/103 |
| 9,138,078 | B2 * | 9/2015 | Barkdoll | A47F 5/0823 |
| 9,550,292 | B1 * | 1/2017 | Putila | B25H 3/04 |
| 10,226,138 | B2 * | 3/2019 | Tear | F16B 9/023 |
| 10,869,561 | B2 * | 12/2020 | Arradondo | H01F 7/0252 |
| 10,932,593 | B2 * | 3/2021 | Altizer | B25H 3/04 |
| 2007/0290107 | A1 * | 12/2007 | Lang | A47F 5/0815 248/220.31 |
| 2009/0108156 | A1 * | 4/2009 | Lang | A47F 5/0815 248/220.31 |
| 2013/0146550 | A1 * | 6/2013 | Stukenberg | A47F 5/0815 211/59.2 |
| 2015/0351561 | A1 * | 12/2015 | Theisen | A47B 47/027 211/186 |
| 2018/0310729 | A1 * | 11/2018 | Tear | A47F 5/0823 |
| 2020/0069082 | A1 * | 3/2020 | Altizer | A47F 5/0815 |
| 2020/0069083 | A1 * | 3/2020 | Spain, Jr. | A47F 5/0823 |

* cited by examiner

PERFORATED BOARD AND HANGER STORAGE SYSTEM

BACKGROUND OF THE INVENTION

1. Field of the Invention

The present invention relates generally to storage systems and specifically to a storage system comprising improved perforated storage boards adapted to receive improved hangers.

2. Description of the Prior Art

Home and business owners immediately recognize that a key to running a successful household or business is organization. Lack of organization promotes inefficiency, waste, and frustration. Thus, the acquisition of "things" requires an efficient storage and organization solution.

For centuries, would-be organizers have used a various assortment of jars, baskets, boxes, containers, cabinets, racks, and shelves in efforts to become better organized. In the 20$^{th}$ century perforated board ("pegboard") storage systems grew in popularity. Pegboard storage systems are generally economic storage solutions that permit users to visualize and easily access the articles stored.

Conventional pegboard comprises evenly spaced holes adapted to receive hanger devices comprising one or more pegs. The pegs are adapted to be inserted into the holes. When so inserted, the hanger is suspended from the pegboard offering a convenient place to store a variety of objects. To accommodate different object configurations, conventional hangers take a variety of forms, including curved hooks, rods, clips, brackets, baskets, bins, and the like.

Holes of conventional pegboard are arranged in rows across the surface of the pegboard. The holes are evenly spaced such that each hole is positioned one inch on-center from an adjacent hole. Standard pegboard hole diameters are 3/16" and 1/4". Standard pegboard thicknesses are 1/8" and 1/4".

Although conventional pegboard storage systems are useful, they are not without certain drawbacks causing users to often become frustrated when mounting and using the pegboard. The primary drawbacks of conventional pegboard storage systems relate to size and configuration.

For example, in order to mount conventional pegboard to a wall, the board must be offset from the wall. Such offset is necessary to create sufficient space for the peg to be inserted properly into the pegboard holes, To create this offset, users typically must position spacer slats between the pegboard and the wall. Such slats are generally arranged at the outside perimeter of the pegboard and at intervals within the perimeter. Although these slats provide support for the pegboard so that it does not bow inward upon insertion of the pegs, the slats obstruct certain holes in portions of the pegboard overlying the slats. Moreover, purchasing, sizing, and positioning the slats is time consuming and adds expense to the pegboard mounting process.

Pegboard sizing can also be frustrating and problematic. Conventional pegboard is sold in 48×24-inch dimensions. Standard vertical studs within walls have 16- or 24-inch on-center spacing. A user having 16-inch stud spacing and desiring to use an entire single piece of conventional pegboard must mount the board lengthwise such that the 48" length lies horizontally across portions of three studs. Mounting such a piece vertically, such that the 48" length is vertical, requires the user to either reduce the 24-inch width to 16 inches or cantilever one end of the 24" width of the board 8" from the center of one of the studs. Neither of these options is desirable.

Another pegboard user frustration relates to how secure the hanger remains after insertion within the pegboard. Many conventional hangers wobble after insertion of the pegs within the pegboard. Various clips, screws, and bands are known to be used to help better secure the hanger to the pegboard. However, such reinforcement devices are more complicated and expensive than a user typically desires.

What is needed is an economical and secure pegboard and hanger system that is easily mounted to a wall without requiring the user to actively offset the board from the wall, that can be mounted easily on walls comprising both 16 and 24 inch stud spacing, and that comprises hangers that can be securely mounted to the pegboard without requiring clips, screws, bands, and the like.

SUMMARY OF THE INVENTION

In preferred embodiments, the system comprises perforated board and hangers, the perforated board comprising a board portion, a perimeter rib structure, and an interior rib structure, the hangers comprising one or more pegs. The board portion comprises board through openings, each of the board though openings being adapted to receive a peg. The board through openings of the preferred embodiment are evenly spaced, the spacing interval being, preferably, one inch on-center. The board portion of the preferred embodiment comprises a 24-inch height, 16-inch width, and 0.62" depth (24"×16"×0.62"). The diameters of the board through openings of the preferred embodiment are 0.235". The board portion of the preferred embodiment comprises a display surface, the surface of the board portion that faces away from the wall to which the board portion is mounted, and a wall facing surface, the surface of the board portion that faces the wall to which the board portion is mounted.

The perimeter and interior rib structures extend from the wall facing surface. In the preferred embodiment, the perimeter rib structure is thicker than the interior rib structure and comprises upper, lower, left-side, and right-side perimeter rib portions. The interior rib structure comprises one or more vertical interior rib portions and one or more horizontal interior rib portions. In the preferred embodiment, the vertical rib portion is positioned at the longitudinal center of the wall facing surface and extends outward. In the preferred embodiment, there are first and second horizontal rib portions, the first horizontal rib portion being positioned between the upper perimeter rib portion and the lower perimeter rib portion approximately 1/3 of the way down from the upper perimeter rib portion. The second horizontal rib portion of the preferred embodiment is positioned between the top perimeter rib portion and the lower perimeter rib portion, approximately 1/3 of the way up from the lower perimeter rib portion.

Immediately adjacent to the perimeter rib structure, there are a plurality of tube portions, each being adapted to receive a fastener such as a screw. Each tube portion comprises a tube through opening. Each tube through opening extends through the board portion and the display surface such that there is a first tube through opening end adjacent to the display surface and a second tube through opening end adjacent to the perimeter rib structure. When mounting the perforated board to the wall, a user inserts, respectively, screws or other suitable fasteners into each of the first through opening ends such that the screws can be driven into the wall. In the preferred embodiment, the first tube through opening end is countersunk. Such countersink feature permits a head of the screw to be flush or below the display surface when inserted into the tube portion.

In the preferred embodiment, the tube portions are arranged at junction points at which portions of the perimeter rib structure meet other portions of the perimeter rib structure and at which portions of the interior rib structure meet portions of the perimeter rib structure. For example, a tube portion is positioned at each corner of the board portion.

The hanger of the preferred embodiment comprises a vertical member, an extension member, an upper peg and a lower peg. The upper peg extends rearward (towards the wall when positioned in the perforated board) from an upper portion of the vertical member. The lower peg extends frontward (away from the wall when positioned in the perforated board) from a lower portion of the vertical member. The extension member is adapted to be used to suspend or hold a variety of objects and can comprise a variety of configurations such as straight, curved, or angular configurations.

The upper peg comprises an upward curve configuration which permits the upper peg to be inserted into one of the board through openings. When so inserted, downward pressure on the extension member causes the upper peg to be pressed against the wall facing surface which helps maintain the hanger in the proper position on the board portion.

In the preferred embodiment, the lower peg comprises a straight configuration and extends at a downward angle from the vertical member. This downward angle, along with the pressure exerted by the upper peg, assists in maintaining the hanger in the desired position. In the preferred embodiment, the downward angle is three to seven degrees. This configuration provides a cam-lock feature such that as the lower peg is inserted into a board through opening (after the upper peg has been inserted into a board through opening one inch above the board through opening into which the lower peg is being inserted), the lower peg flexes and cam-locks into the board through opening into which the lower peg is being inserted. This cam-lock feature prevents the hanger from being inadvertently removed from the board portion upon removal of items suspended from the hanger. However, the user can readily remove the hanger by grasping the hanger and imparting an outward and upward motion on the hanger.

Distal ends of both the upper and lower pegs are rounded such that they taper. This rounding assists the user in inserting respective pegs into the board through openings.

In certain embodiments, the hanger comprises a horizontal plate member. In such embodiments, the horizontal plate member extends horizontally from the vertical member. A rear surface of the horizontal plate member is flush with a rear surface of the vertical member such that the horizontal plate member is co-planar with the display surface and the wall facing surface. When the hanger is coupled to the board portion as described herein, the horizontal plate member provides lateral stability to the hanger so that side to side movement of the hanger is reduced.

In the preferred embodiment, the components of the perforated board and hanger storage system are injection molded from polypropylene. The surfaces of the perforated board of the preferred embodiment are easy to clean and solvent resistant. Although the components of the preferred embodiment are formed from polypropylene, the components need not be formed of polypropylene. Rather, the components can be formed from any suitable material known in the art, including, but not limited to wood, metal, other plastics such as ABS (Acrylonitrile Butadiene Styrene); PC (Polycarbonate); PA or PPA (Aliphatic Polyamides); POM (Polyoxymethylene); PMMA (Polymethyl Methacrylate); PBT (Polybutylene Terephthalate); PPSU (Polyphenylsulfone); PEEK (Polyether Ether Ketone); and PEI (Polyetherimide).

DESCRIPTION OF THE PREFERRED EMBODIMENT

Figure 1:
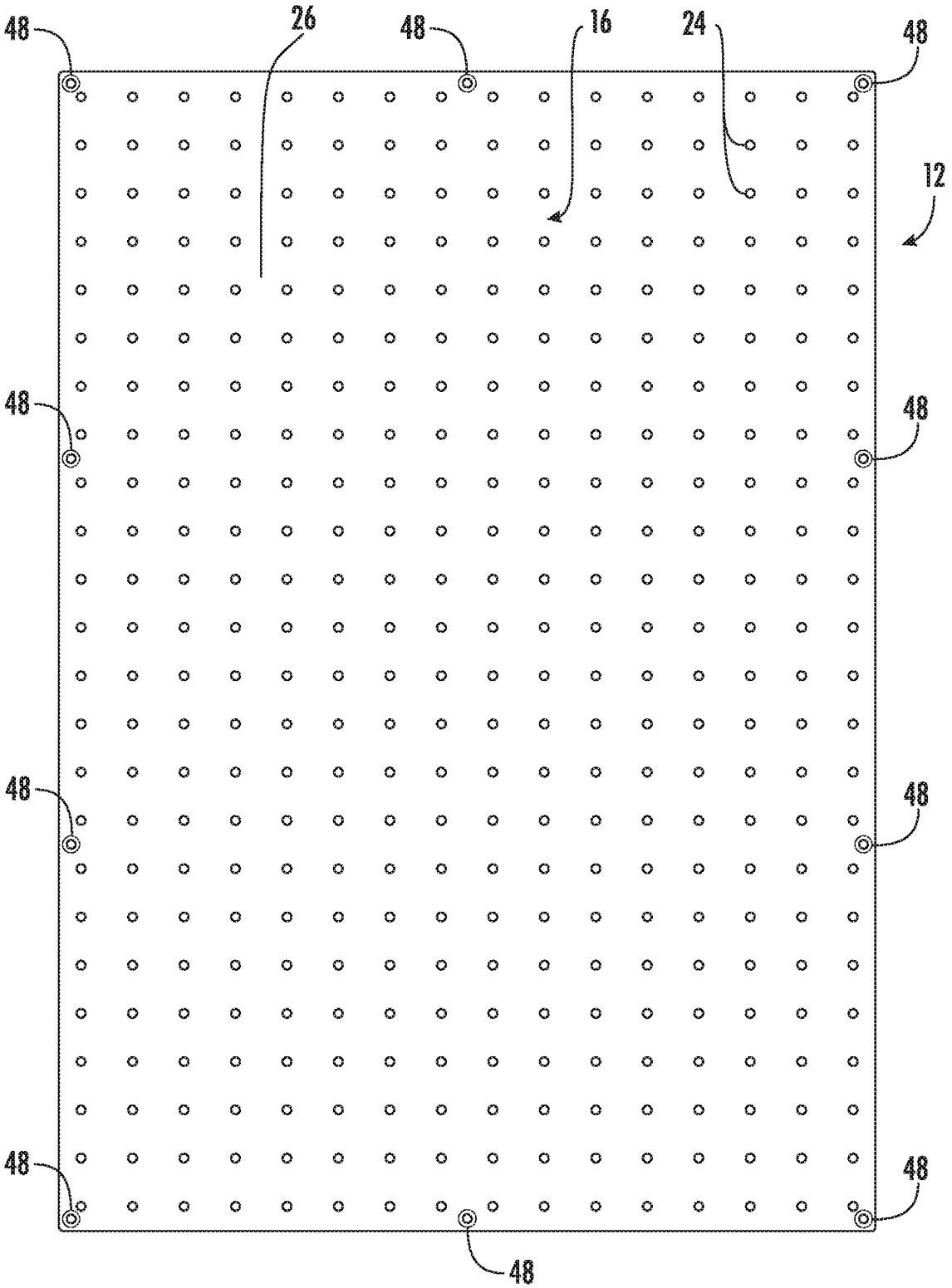
FIG. 1 is an elevation view of the front side of the perforated board, in accordance with a preferred embodiment.
Figure 2:
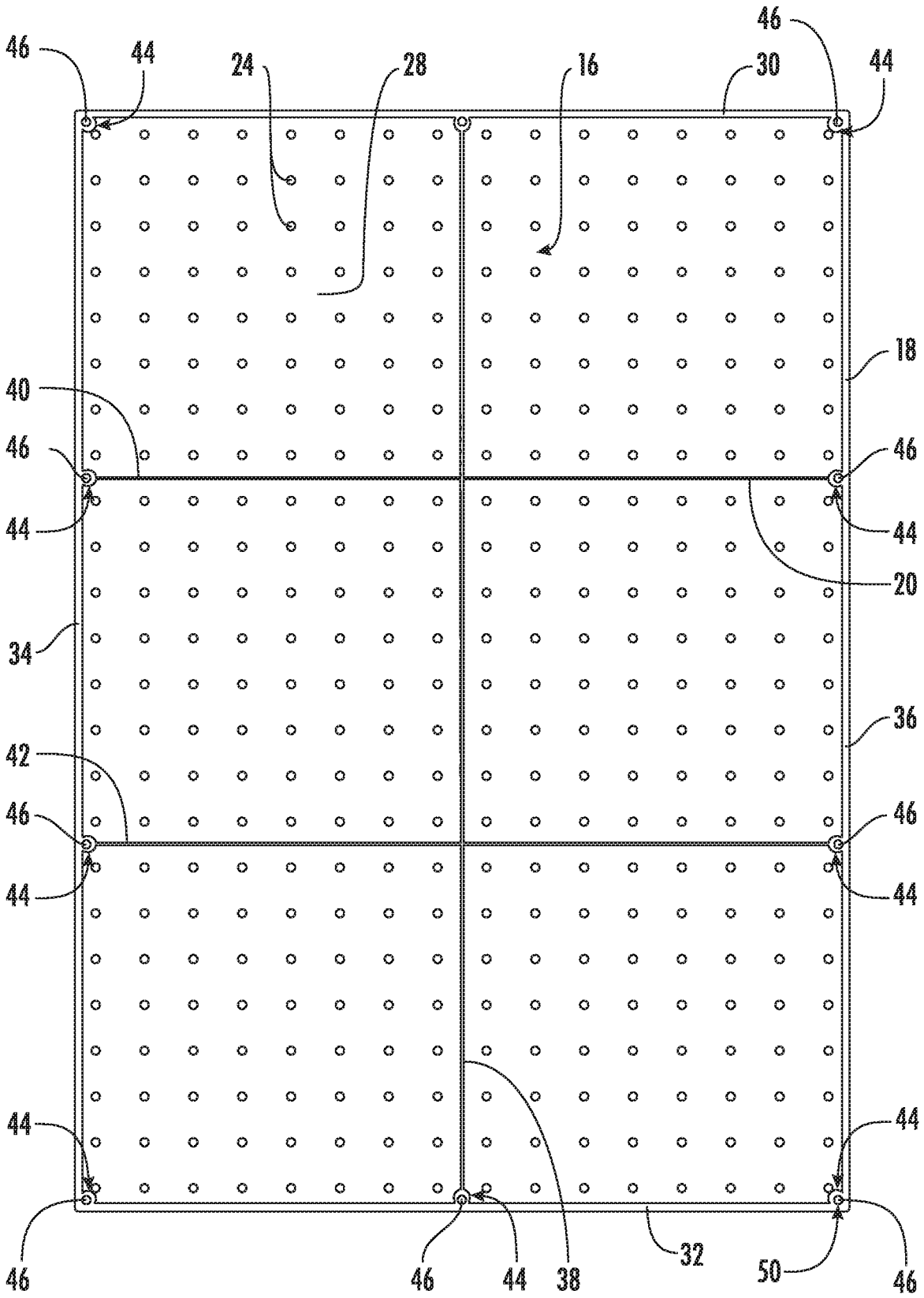
FIG. 2 is an elevation view of the rear side of the perforated board of FIG. 1.
Figure 3:
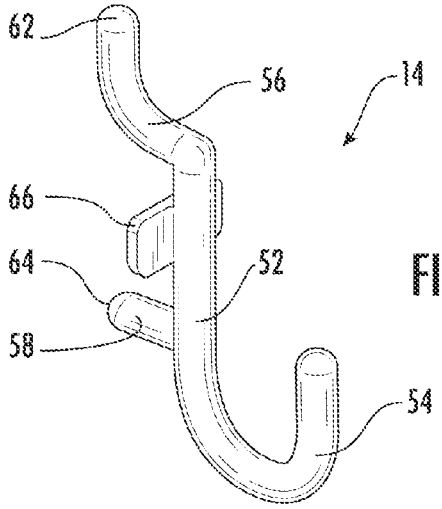
FIG. 3 is a front and side isometric view of the hanger, in accordance with a preferred embodiment.
Figure 4:
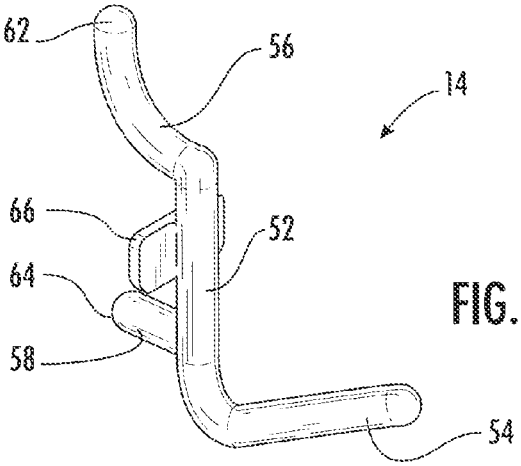
FIG. 4 is a front and side isometric view of the hanger, in accordance with another embodiment.

Referring to FIGS. 1 & 2 and FIGS. 3-8, there is shown the perforated board 12 and hangers 14, respectively, in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination, Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Referring to the figures, in preferred embodiments, the system 12, 14 comprises a perforated board 12 and hangers 14, the perforated board 12 comprising a board portion 16, a perimeter rib structure 18, and an interior rib structure 20, the hangers 14 comprising one or more pegs 56,58. The board portion 16 comprises board through openings 24, each of the board though openings 24 being adapted to receive a peg 56,58. The board through openings 24 of the preferred embodiment are evenly spaced, the spacing interval being, preferably, one inch on-center. The board portion 16 of the preferred embodiment comprises a 24-inch height, 16-inch width, and 0.62" depth (24"×16"×0.62") and is formed from a co-polymer such as polypropylene. The board portion 16 of the preferred embodiment comprises a display surface 26, the surface of the board portion 16 that faces away from the wall (not shown) to which the board portion 16 is mounted, and a wall facing surface 28, the surface of the board portion 16 that faces the wall to which the board portion 16 is mounted. The display surface 26 and wall facing surface 28 preferably have a distance between them of approximately 0.125 inches.

The perimeter and interior rib structures 18, 20 extend from the wall facing surface 28, and, in the preferred embodiment are integrated/fused to the wall facing surface 28 as a result of the injection molded process with which the perforated board 12 is formed. The perimeter rib structure 18 of the preferred embodiment defines the perimeter boundaries of the perforated board 12.

In the preferred embodiment, the perimeter rib structure 18 is thicker than the interior rib structure 20 and comprises upper 30, lower 32, left-side 34, and right-side 36 perimeter rib portions 30,32,34,36. The perimeter rib structure 18 of the preferred embodiment comprises a total depth of approximately 0.62 inches. Thus, the perimeter rib structure 18 extends outward from the wall facing surface 28 a distance of approximately 0.495 inches. The interior rib structure 20 comprises one or more vertical interior rib portions 38 and one or more horizontal interior rib portions 40, 42. In the preferred embodiment, the vertical rib portion 38 is positioned at the longitudinal center of the wall facing surface 28 and extends outward 0.495 inches. In the preferred embodiment, there are first and second horizontal rib portions 40, 42, the first horizontal rib portion 40 being positioned between the upper perimeter rib portion 30 and the lower perimeter rib portion 32 approximately ⅓ of the way down from the upper perimeter rib portion 30. The second horizontal rib portion 42 of the preferred embodiment is positioned between the upper perimeter rib portion 30 and the lower perimeter rib portion 32, approximately ⅓ of the way up from the lower perimeter rib portion 32. Thus, the first horizontal rib portion 40 of the preferred embodiment is eight inches below the upper perimeter rib portion 30 and the second horizontal rib portion 42 is eight inches below the first horizontal rib portion 40. The vertical rib portion 38 of the preferred embodiment is eight inches from both the left and right-side perimeter rib portions 34, 36.

Immediately adjacent to the perimeter rib structure 18, there are a plurality of tube portions 44, each being adapted to receive a fastener such as a screw. Each tube portion 44 comprises a tube through opening 46. Each tube through opening 46 extends through the board portion 16 and the display surface 26 such that there is a first tube through opening end 48 adjacent to the display surface 26 and a second tube through opening end 50 adjacent to the perimeter rib structure 18. When mounting the perforated board 12 to the wall, a user inserts screws or other suitable fasteners into each of the first through opening ends 48 such that the screws can be driven into the wall. In the preferred embodiment, the first tube through opening end 48 is countersunk. Such countersink feature permits a head of the screw to be flush or below the display surface 26 when inserted into the tube portion 44.

In the preferred embodiment, the tube portions 44 are arranged at junction points at which portions of the perimeter rib structure 18 meet other portions of the perimeter rib structure 18 and at which portions of the interior rib structure 20 meet portions of the perimeter rib structure 18. For example, a tube portion 44 is positioned at each corner of the board portion 16. There is a tube portion 44 at the junction of the vertical interior rib portion 38 and the upper perimeter rib portion 30; and a tube portion 44 at the junction of the vertical interior rib portion 38 and the lower perimeter rib portion 32. There is a tube portion 44 at the junction of the first horizontal rib portion 40 and the left-side perimeter rib portion 34; and a tube portion 44 at the junction of the first horizontal rib portion 40 and the right-side perimeter rib portion 36. Similarly, there is a tube portion 44 at the junction of the second horizontal rib portion 42 and the left-side perimeter rib portion 34; and a tube portion 44 at the junction of the second horizontal rib portion 42 and the right-side perimeter rib portion 36.

The hanger 14 of the preferred embodiment comprises a vertical member 52, an extension member 54, an upper peg 56 and a lower peg 58. As a result of the molding process, the hanger 14 of the preferred embodiment is a single integral/fused piece. The upper peg 56 extends rearward (towards the wall when positioned in the perforated board 12) from an upper portion of the vertical member 52. The extension member 54 extends frontward (away from the wall when positioned in the perforated board 12) from a lower portion of the vertical member 52. The extension member 54 is adapted to be used to suspend or hold a variety of objects and can comprise a variety of configurations such as straight (as shown, for example, in FIGS. 4 & 7), curved (as shown, for example, in FIGS. 3 & 6), or angular configurations (as shown, for example, in FIGS. 5 & 8).

The upper peg 56 comprises an upward curve configuration which permits the upper peg 56 to be inserted into one of the board through openings 24, When so inserted, downward pressure on the extension member 54 causes the upper peg 56 to be pressed against the wall facing surface 28 which helps maintain the hanger 14 in the proper position on the perforated board 12.

In the preferred embodiment, the lower peg 58 comprises a straight configuration and extends at a downward angle 60 from the vertical member 52. This downward angle 60, along with the pressure exerted by the upper peg 56, assists in maintaining the hanger 14 in the desired position. In the preferred embodiment, the downward angle 60 is three to seven degrees below horizontal 22. The lower peg 58 is flexible, allowing it to be bent slightly upon insertion. After insertion, the lower peg 58 returns to its original angled position. This configuration provides a cam-lock feature such that as the lower peg 58 is inserted into a board through opening 24 (after the upper peg 56 has been inserted into a board through opening 24 one inch above the board through opening 24 into which the lower peg 58 is being inserted), the lower peg 58 flexes and cam-locks into the board through opening 24 into which the lower peg 58 is being inserted. This cam-lock feature prevents the hanger 14 from being inadvertently removed from the board portion 16 upon removal of items suspended from the hanger 14. However, the user can readily remove the hanger 14 by grasping the hanger 14 and imparting an outward and upward motion on the hanger 14.

Distal ends 62, 64 of both the upper and lower pegs 56,58 are rounded such that they taper. This rounding assists the user in inserting the respective pegs 56,58 into the board through openings 24.

As shown in FIGS. 3, 4, 6, and 7, in certain embodiments, the hanger 14 comprises a horizontal plate member 66. In such embodiments, the horizontal plate member 66 extends horizontally from the vertical member 52. A rear surface of the horizontal plate member 66 is flush with a rear surface of the vertical member such that the horizontal plate member 66 is co-planar with the display surface 26 and the wall facing surface 28. When the hanger 14 is coupled to the board portion 16 as described herein, the horizontal plate member 66 provides lateral stability to the hanger 14 so that side to side movement of the hanger 14 is reduced.

Figure 5:
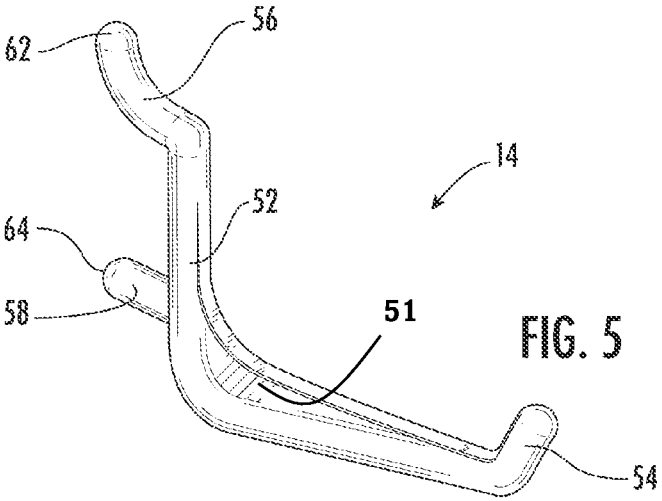
FIG. 5 is a front and side isometric view of the hanger, in accordance with another embodiment.
Figure 6:
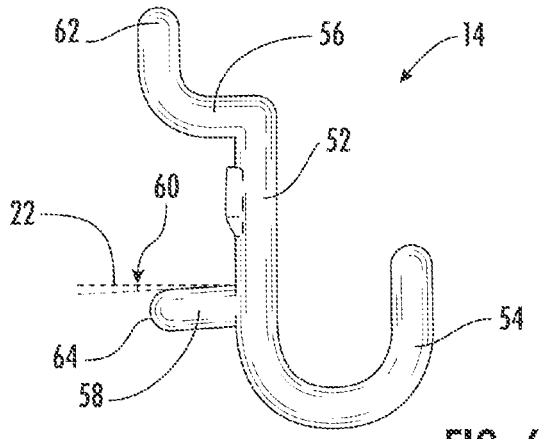
FIG. 6 is a side elevation view of the hanger of FIG. 3.
Figure 7:
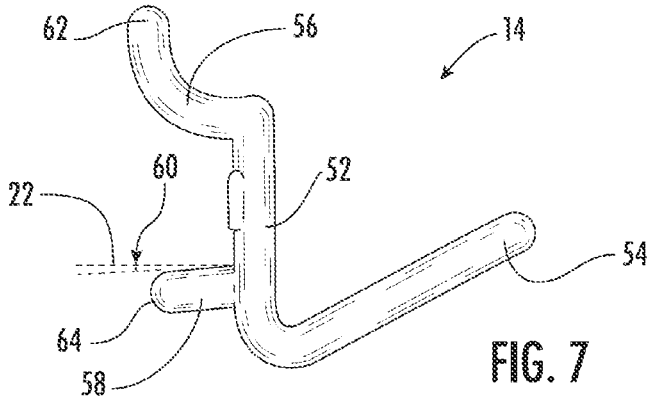
FIG. 7 is a side elevation view of the hanger of FIG. 4.
Figure 8:
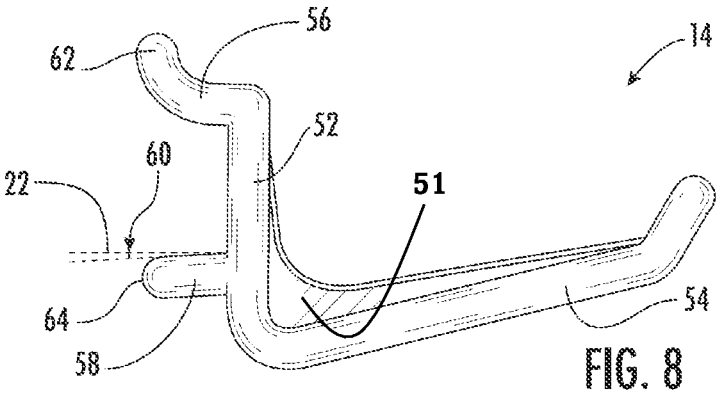
FIG. 8 is a side elevation view of the hanger of FIG. 5.

In certain embodiments, the hanger 14 comprises a reinforcement member 51. As shown in FIGS. 5 and 8, the reinforcement member 51 spans arcuately frontward between the vertical member and the extension member from a position above a midpoint of the vertical member to a position beyond a midpoint of the extension member.

This disclosure and the showings made in the drawings are merely illustrative of the principles of this invention and are not to be interpreted in a limiting sense. While the invention is shown in only a few forms, it is not just limited to the forms shown, but is susceptible to various changes and modifications without departing from the spirit thereof.

For example, although Applicant has described various sizes and dimensions, the components of the system 12, 14 can comprise various sizes and dimensions. Although the board through openings 24 are spaced one inch apart in the preferred embodiment, the spacing can be greater or lesser than one inch. By way of further example, although the perforated board 12 is described herein as being 24"×16"×0.62", the perforated board 12 can have greater or lesser lengths, widths, and depths than these without departing from the scope and spirit of this disclosure.

In the preferred embodiment, the components of the perforated board and hanger storage system 12,14 are injection molded from polypropylene. However, the components need not be formed of polypropylene. Rather, the components can be formed from any suitable material known in the art, including, but not limited to wood, metal, other plastics such as ABS (Acrylonitrile Butadiene Styrene); PC (Polycarbonate); PA or PPA (Aliphatic Polyamides); POM (Polyoxymethylene); PMMA (Polymethyl Methacrylate); PBT (Polybutylene Terephthalate); PPSU (Polyphenylsulfone); PEEK (Polyether Ether Ketone); and PEI (Polyetherimide), or other material that permits the components to function as described herein.

Thus, the foregoing description of preferred embodiments of the invention has been presented for the purpose of illustration and description. It is not intended to be exhaustive or to limit the invention to the precise form disclosed. Obvious modifications or variations are possible in light of the above teachings. The invention may be adapted for use in a number of environments. The embodiments were chosen and described to provide the best illustrations of the principles of the invention and its practical application, and to enable one of ordinary skill in the art to utilize the invention in various embodiments and with various modifications as are suited to the particular use contemplated. All such modifications and variations are within the scope of the invention in accordance with the breadth of this disclosure, to which it is fairly, legally, and equitably entitled to be interpreted.

I claim:

1. A perforated board and hanger storage system comprising:

a perforated board and one or more hangers;

the hangers comprising a vertical member, an extension member, a reinforcement member, an upper peg and a lower peg;

the perforated board comprising a board portion, a perimeter rib structure, and an interior rib structure;

the board portion comprising a plurality of board through openings adapted to receive one of the pegs;

the board portion comprising a display surface and a wall facing surface;

the perimeter and interior rib structures being fused to and extending from the wall facing surface;

the perimeter rib structure comprising upper, lower, left-side, and right-side perimeter rib portions;

the upper and left-side perimeter rib portions forming a first junction at a position at which the upper and left-side perimeter rib portions meet; the upper and right-side perimeter portions forming a second junction at a position at which the upper and right-side perimeter portions meet; the lower and right-side perimeter rib portions forming a third junction at a position at which the lower and right-side perimeter rib portions meet; the lower and left-side perimeter portions forming a fourth junction at a position at which the lower and left-side perimeter portions meet;

a plurality of tube portions comprising tube through openings adapted to receive a fastener, the tube through openings being different from the board through openings, at least one of the tube portions being incorporated within a corner of the perimeter rib structure;

the upper peg extending rearward from an upper portion of the vertical member;

the lower peg, in its entirety, extending rearward at a downward angle along a straight line from the vertical member to a terminus of the lower peg;

the extension member extending frontward from a lower portion of the vertical member, the extension member being adapted for suspending an object;

the reinforcement member arcuately spanning frontward between the vertical member and the extension member from a position above a midpoint of the vertical member to a position beyond a midpoint of the extension member;

the upper peg comprising an upward curve configuration.

2. The perforated board and hanger storage system of claim 1, wherein the downward angle at which the lower peg extends from the vertical member ranges between 3-7 degrees below horizontal when the vertical member is in a vertical position.

3. The perforated board and hanger storage system of claim 1, the upper and lower pegs each comprising distal ends, wherein one or both of the distal ends is tapered.

4. The perforated board and hanger storage system of claim 1, wherein the lower peg is flexible such that it is adapted to be bent upon insertion into one of the board through openings.

5. The perforated board and hanger storage system of claim 1, further comprising a horizontal plate member extending outward from the vertical member.

6. The perforated board and hanger storage system of claim 1, wherein the interior rib structure comprises vertical and horizontal interior rib portions.

7. The perforated board and hanger storage system of claim 1, wherein the perimeter and interior rib structures do not obstruct the plurality of board through openings.

* * * * *